US005409071A

United States Patent [19]

Wellington et al.

[11] Patent Number: 5,409,071

[45] Date of Patent: Apr. 25, 1995

[54] METHOD TO CEMENT A WELLBORE

[75] Inventors: Scott L. Wellington; Harold J. Vinegar, both of Houston; Thomas C. Gipson, Eastland, all of Tex.

[73] Assignee: Shell Oil Company, Houston, Tex.

[21] Appl. No.: 247,828

[22] Filed: May 23, 1994

[51] Int. Cl.[6] ..... E21B 19/22; E21B 33/13; E21B 33/14

[52] U.S. Cl. ..... 166/253; 166/290; 166/292; 166/384; 166/295

[58] Field of Search ..... 166/290, 285, 292, 384, 166/295, 253; 405/240, 269

[56] References Cited

U.S. PATENT DOCUMENTS

| | | | |
|---|---|---|---|
| 2,171,840 | 9/1939 | Armenstrout et al. | 166/253 |
| 3,612,181 | 10/1971 | Brooks | 166/295 |
| 3,637,019 | 1/1972 | Lee | 166/295 |
| 3,878,686 | 4/1975 | Hageman et al. | 166/295 X |
| 4,120,166 | 10/1978 | Brooks, Jr. | 166/253 X |
| 4,229,122 | 10/1980 | Ballantyne | 166/253 X |
| 4,302,132 | 11/1981 | Ogawa et al. | 405/269 |
| 4,449,856 | 5/1984 | Tokoro et al. | 405/269 |
| 4,673,035 | 6/1987 | Gipson | 166/77 |
| 4,867,240 | 9/1989 | Colla | 166/290 |

FOREIGN PATENT DOCUMENTS 1065579A 7/1984 U.S.S.R. .

*Primary Examiner*—Stephen J. Novosad
*Attorney, Agent, or Firm*—Del S. Christensen

[57] ABSTRACT

A method to cement a wellbore is provided wherein two fluids are transported into the wellbore through separate conduits, and combined within the volume to be cemented. The two fluids set to become a hardened cement after a short time period. The two fluids are preferably passed through a static mixer at the ends of the conduits within the wellbore to provide uniform contact between the two fluids. The two fluids are preferably a wellbore cement and an accelerator for that cement. Because the cement sets within a short time period, fluid loss from the wellbore is minimal. Additionally, the static head to which the formation is exposed is not excessive, even if a cement slurry having a density that exceeds the hydraulic fracture gradient of the formation is used.

16 Claims, No Drawings

METHOD TO CEMENT A WELLBORE

FIELD OF THE INVENTION

This invention relates to an improved method to cement a wellbore.

BACKGROUND OF THE INVENTION

Casings are typically cemented into wellbores by circulating a cement slurry through the inside of a casing, out the bottom of the casing and up the annulus between the outside of the casing and the wellbore until a cement slurry level outside the casing is reached to which the wellbore is to be cemented. The cement then hardens to form a seal around the casing. Because the column of cement slurry must be fluid until the last of the cement slurry is forced into the annulus around the casing from the bottom, this method requires that the cement slurry is of a density that does not exceed the hydraulic fracture gradient of the formation around the wellbore. If this gradient is exceeded, the formation can fracture and cause the cement to be lost into the fracture. A cement slurry of a density that exceeds the formation hydraulic fracture gradient may be desired because such slurries can have greater mechanical strength, better bonding to the casing and the formation, better tolerance to elevated temperatures and greater thermal conductivity.

Further, the cement slurry must be of a density that is great enough to provide a wellbore pressure that exceeds the formation pore pressure to prevent formation fluids from invading the wellbore and interfering with the setting of the cement. It is occasionally difficult to match the density of the cement slurry to the range of densities that will satisfy these requirements.

To prevent lost circulation, when it is desirable to use a cement slurry that has a density that exceeds the fracture gradient of the formation, the cement slurry can be placed in stages directly into an annulus between the casing and the formation using a coiled tubing. An apparatus for injection of a coiled tubing into such an annulus is disclosed in, for example, U.S. Pat. No. 4,673,035. Placement of cement slurry in stages is time consuming because each stage must gel before a stage can be set above it. This makes placement of cement in stages very expensive due to equipment rental costs and the delay in completion of the well.

Conventional placement of cement from the bottom of the casing and up the annulus requires that the cement set relatively slowly because the entire annulus must be filled with cement slurry before the first cement placed in the annulus starts to become hard. When the formation within which a casing is to be cemented causes significant water loss from the cement slurry, the top of the column of cement will settle a significant amount between the time the cement slurry is placed and the time the column of cement slurry is fully hardened. This settling can be attributed to water loss from the cement slurry. Water loss additives can be added to the cement slurry, but water loss additives can be expensive and some settling will typically occur even when water loss additives are included in the cement slurry. Water loss alters the chemistry of the cement slurry resulting in inconsistent and suboptimal set cement properties. The final height of the cement is also unpredictable.

Injection of cements and curing agents through separate conduits within a casing is disclosed in, for example, the abstract of Russian Patent No. 465,583. This Russian patent abstract discloses such a method in order to provide a quickly setting cement in permafrost conditions.

Separate injection of grouts and curing agents through conduits within the casing is disclosed in U.S. Pat. Nos. 4,302,132 and 4,449,856. These grouts are intended to fill voids and thief zones within a formation with a quickly setting grout. The methods of these patents could not be used to place cement in a significant length of wellbore annulus because they are discharged from the bottom of the casing and will become hard before a significant portion of the annulus could be filled.

It is therefore an object of the present invention to provide a method to place cement in a wellbore wherein the cement hardens sufficiently fast that significant water loss from the cement does not occur. It is a further object of the present invention to provide such a method wherein the cement can be placed in a formation that has a hydraulic fracture gradient significantly less than the static head that would be formed by the cement slurry. It is another object to provide such a method wherein the cement can be placed over an extended length of the wellbore in a single continuous operation.

SUMMARY OF THE INVENTION

These and other objects are accomplished by a method for providing a set cement within a volume in a wellbore, the method comprising the steps of: providing two conduits, each conduit having an end terminating in a lower portion of the volume in the wellbore to be cemented; providing two fluids that when combined, form a cement slurry that hardens within a short time; passing the two fluids to the lower portion of the volume in the wellbore through the two conduits so that the two fluids combine in the volume in the wellbore creating a rising level of cement slurry in the volume in the wellbore; raising the ends of the two conduits within the volume in the wellbore at about the same rate as a level of the cement rises within the volume to be cemented; and allowing the cement to harden within the volume within the wellbore.

The fluids are preferably a known wellbore cement and an accelerator. The amount of accelerator is preferably sufficient to result in the cement slurry hardening within about thirty minutes. The two conduits are preferably concentric tubes that are placed within the wellbore from a coiled tubing unit.

In a preferred embodiment of the present invention, the level of cement slurry in the wellbore is monitored and the ends of the conduits are raised as the level of cement slurry is increased so that the ends of the conduits are maintained within about five to about thirty feet below the top level of the slurry. Monitoring the level prevents the ends of the conduits from becoming too deep within the slurry and possibly being within hardening slurry or being too far above the slurry level and trapping drilling fluids and causing voids within the slurry. The level can be monitored independently of the conduits, for example, by a wireline detector suspended within the casing, or the level could be monitored by detectors attached to one of the conduits such as one or more conductivity sensors attached to the conduit.

The fluids that can be combined may be selected from a wide variety of fluids, such as, for example, epoxies and crosslinking agents, blast furnace slag and sodium carbonate accelerator solution, Portland cement and a cement accelerator, or a high alumina cement and a sodium aluminate or lithium hydroxide accelerator.

DETAILED DESCRIPTION OF THE INVENTION

The present invention is preferably utilized to place cement in a wellbore in an annulus between the formation and a casing. The two conduits may be placed within the wellbore from two coiled tubing units. Alternatively, and preferably, a small tube may be threaded inside of a larger tube, and injected from a single coiled tubing unit. The ends of each conduit may be connected to a static mixer so that the combined fluids pass through the static mixer. This ensures uniform mixing of the two fluids before entering the wellbore region. The conduits could be secured together and lowered from a typical drilling or workover rig, but this is not preferred because it would take a considerably longer time to place the cement if joints of tube would have to be removed continually in order to raise the tube as the volume to be cemented is filled with cement slurry.

The fluids that are combined to form a cement slurry that hardens within a short time to form a hardened cement may be selected from a wide variety of compositions. Conventional Portland wellbore cement slurries may be used in conjunction with know accelerators. Blast furnace slag wellbore cements are preferred in the practice of the present invention because blast furnace slag cement slurries can be prepared with retarders such as lignosulfates that cause the slurry to remain pumpable for long periods of time, but harden quickly when combined with accelerators such as sodium carbonate, sodium hydroxide, or mixtures thereof.

Fluids can be used in the practice of the present invention that are not typically considered to be wellbore cements because of the elimination of the need to delay the development of gel strength. For example, epoxies and crosslinking agents could be combined. Such epoxies may optionally be provided with aggregates or fillers. Polymers or solutions of polymers that can be crosslinked at functional sites, such as many ionomers, may be used with crosslinking agents. Phosphates may be combined with metal oxides to quickly form solids by combining slurries or solutions of these components in the wellbore. When fluids are combined in the wellbore that set quickly, it is particularly preferred to monitor the interface of the fluids and to keep the end of the conduits near the interface to prevent the conduits from becoming stuck in the cement.

The advantages of the present invention can be particularly significant when a wellbore cement is required that is very dense. For example, high alumina cements are preferred when the wellbore will be exposed to elevated temperatures. Such cements can be operated at temperatures exceeding 2000° F., but are preferably prepared from very dense slurries. Setting of such slurries may be effectively accelerated by adding a sodium aluminate or lithium hydroxide solution to the slurry. Less than 0.1 percent by weight of sodium aluminate based on the dry weight of the alumina cement can result in set times of less than fifteen minutes. The slurry without the accelerator will not set for hours. Placement of a quickly setting slurry by the method of the present invention prevents the reservoir from being fractured and loss of cement into those fractures because the formation is not exposed to an excessive static head due to the column of cement slurry in the wellbore.

The level of the cement slurry within the wellbore is preferably monitored to ensure that the end of the fluid conduits are maintained within a desired distance below the surface of the cement. If the ends of the fluid conduits are above the slurry level, the slurry may be diluted with drilling fluids. If the ends of the fluids conduits are too far below the ends of the conduits, the conduits may become trapped in the cement. Commercially available well logging services are capable of providing such monitoring from inside the casing. An NFD (non-focused density or nuclear fluid density) log available from Schlumberger is an example. This is a gamma ray log that can be logged inside the casing. The cement slurry will have higher density (fewer detector counts) than drilling mud. The NFD has maximum sensitivity to the annular space outside of the casing. This method of monitoring the slurry level is accurate but is also relatively expensive.

Slurry levels may alternatively be monitored from inside of a casing by sonic or ultrasonic methods that are well known in the art. A series of ultrasonic level detectors may be suspended from a wireline within a casing, or a single detector may be raised and lowered to monitor the location of the slurry level.

Alternatively, conductivity sensors could be attached to the lower end of one of the conduits. A single conductivity detector could be placed a distance above the lower ends of the conduits, and the conduit raised a set distance, for example ten feet, when the conductivity of the cement slurry is detected by the sensors. Raising the conduits will then lift the conductivity detectors from the cement slurry and into the drilling fluid or drilling mud above the cement slurry and the detected conductivity will change. Typically, because of the lower water content, the cement slurry will have lower conductivity than the drilling mud.

Another measurement device would be differential pressure sensors outside of the conduit. The pressure differential will be proportional to the average density of any drilling mud and cement slurry between the sensing locations. The sensing locations could be spaced, for example, between about five and about thirty feet above the bottom of the conduits.

It is preferred that the ends of the conduits be maintained between about five and about thirty feet below the surface of the cement slurry in the wellbore. At this distance the conduits are not likely to become stuck in the cement. The ends of the conduits are preferably keep below the level of the cement slurry because the cement slurry will then more fully displace wellbore fluids and provide a continuous cement seal around the casing.

The fluids combined within the borehole in the practice of the present invention form a set cement within a short time. This short time can vary depending upon the requirements of the particular operation, but will typically be less than about two hours. It is preferred that the fluids set in about ten to about sixty minutes and more preferably between about ten and about thirty minutes. The cement does not have to become as hard as it will eventually become in order for it to be set according to the present invention. Many cements continue to increase in strength for weeks. The cement is preferably set within the short time to a gel strength that results in the weight of a column of cement slurry above the set cement to be transferred to the wellbore and not to the wellbore contents below the set cement.

EXAMPLES

The advantages of the present invention were demonstrated in cementing two 300 foot deep wellbores, one with an accelerator being injected with a high alumina cement, and one being cemented without the accelerator. Both wellbores penetrated a combination of sands and shales. The cement slurry injected with the accelerator had a weight of about 22 pounds per gallon, and the slurry injected with no accelerator had a weight of about 19.8 pounds per gallon. The cement was injected into both wellbores through a 1.2 inch internal diameter tube from a coiled tube injector. The cement was a "SECAR" 80 cement (available from LaFarge) with a high alumina "MULCOA-60" aggregate (available from C-E Minerals). The cement slurry solids consisted of about forty percent by weight "SECAR 80" and about sixty percent by weight "MULCOA-60" aggregate. About one half of a pound of "XCD" (a xanthan gum available from Kelco) per barrel of slurry was also included in the composition as a thickener and a retarder to prevent setting prior to the combination of the cement with the accelerator. The accelerator was a 0.5 percent by weight aqueous solution of lithium hydroxide. The accelerator solution was injected to form a final slurry in the wellbore of about 0.15 percent by weight of lithium hydroxide based on the water in the slurry. To provide a conduit for injection of the accelerator solution, a 0.5 inch outside diameter stainless steel tube was threaded through the entire coiled tubing. The end of the accelerator solution conduit was fixed to a Kenics static mixer (available from Chemineer, Inc, N. Andover, Mass.) at the end of the coiled tubing, and the static mixer was welded to the end of the coiled tube.

The coiled tubing was placed in the first 300 foot deep well and the cement slurry and accelerator solutions were co-injected as the tubing was raised. The level of the cement slurry was monitored by a non-focused density log (NFD log available from Schlumberger) run inside of the casing. The end of the static mixer was kept between about 6 and about 10 feet below the top level of the cement slurry in the wellbore. The second well was cemented using the same procedure except the accelerator was not co-injected with the cement slurry. After the cement had set, the level of the cement in the first well was the same as it was immediately following the placement of the cement slurry in the wellbore. Before the cement had hardened in the second wellbore, the top level of the cement had settled by over five and one half feet, or about two percent of the total height of cement even though a lower density slurry was used.

The preceding examples and described embodiments are exemplary and reference to the following claims should be made to determine the full scope of the present invention.

We claim:

1. A method for providing a set cement within a volume in a wellbore, the method comprising the steps of:

providing two conduits, each conduit having an end terminating in a lower portion of the volume in the wellbore to be cemented;

providing two fluids that, when combined, form a cement slurry that hardens within a short time;

passing the two fluids to the lower portion of the volume in the wellbore through the two conduits so that the two fluids combine in the volume in the wellbore creating a rising level of cement slurry in the volume in the wellbore;

raising the ends of the two conduits within the volume in the wellbore at about the same rate as a level of the cement rises within the volume to be cemented; and allowing the cement slurry to harden within the volume in the wellbore.

2. The method of claim 1 wherein the level of the cement slurry in the wellbore is measured and the ends of the conduits are raised with the rising level and maintained between about five and about thirty feet below the slurry level.

3. The method of claim 1 wherein the end of the two conduits are both connected to a static mixer wherein the flow through the conduits are mixed together by the static mixer.

4. The method of claim 1 wherein the two conduits are concentric tubes placed within the wellbore from a coiled tubing unit.

5. The method of claim 1 wherein the short time period is a time period of between about ten and about sixty minutes.

6. The method of claim 1 wherein the two fluids are a slurry of blast furnace slag and a solution of an accelerator for setting a blast furnace slag slurry.

7. The method of claim 6 wherein the accelerator for setting a blast furnace slag slurry comprises sodium carbonate and sodium hydroxide.

8. The method of claim 1 wherein the two fluids are a slurry of a high alumina cement and an accelerator for setting a high alumina cement slurry.

9. The method of claim 8 wherein the accelerator for setting the high alumina cement slurry comprises sodium aluminate.

10. The method of claim 8 wherein the accelerator for setting the high alumina cement slurry comprises lithium hydroxide.

11. The method of claim 1 wherein the two fluids are a Portland cement slurry and a solution of an accelerator for setting a Portland cement slurry.

12. The method of claim 1 wherein the volume in the wellbore is an annulus between a casing and the formation.

13. The method of claim 2 wherein the volume in the wellbore is an annulus between a casing and the formation and the level of the cement slurry is measured with a level detection instrument suspended within the casing.

14. The method of claim 2 wherein the volume in the wellbore is an annulus between a casing and the formation and the level of the cement slurry is measured with a level detection device attached to one of the conduits.

15. The method of claim 14 wherein the level detection device is a conductivity measuring device.

16. The method of claim 14 wherein the level detection device is a differential pressure transducer.

* * * * *